United States Patent [19]

Dumesnil, Jr.

[11] 4,107,815

[45] Aug. 22, 1978

[54] TRAY HAVING PAINT TRANSFER ROLLER FOR PAD PAINTERS

[75] Inventor: Eugene F. Dumesnil, Jr., Glen Rrock, N.J.

[73] Assignee: Tip Top Industries, Inc., Jersey City, N.J.

[21] Appl. No.: 840,257

[22] Filed: Oct. 6, 1977

[51] Int. Cl.[2] ..... B44D 3/12

[52] U.S. Cl. ..... 15/257.05; 118/258; 220/1 C; 220/85 R

[58] Field of Search ..... 15/104.92, 248 A, 257.05, 15/257.06, 262; 118/252, 258; 222/403; 242/55.2; 401/118

[56] References Cited

U.S. PATENT DOCUMENTS

| | | | |
|---|---|---|---|
| 297,043 | 4/1884 | Wheeler | 242/55.2 |
| 588,141 | 8/1897 | Grigg | 15/262 |
| 1,069,108 | 8/1913 | Buhl | 242/55.2 |
| 1,776,655 | 9/1930 | Estes | 248/112 X |
| 3,079,625 | 3/1963 | Rasmussen | 15/257.06 |
| 3,135,000 | 6/1964 | Rasmussen | 15/257.06 X |
| 3,648,322 | 3/1972 | Meisner | 15/104.92 X |

FOREIGN PATENT DOCUMENTS

| | | | |
|---|---|---|---|
| 2,501,401 | 7/1976 | Fed. Rep. of Germany | 15/257.05 |
| 920,422 | 3/1963 | United Kingdom | 242/55.2 |

*Primary Examiner*—Daniel Blum
*Attorney, Agent, or Firm*—Stoll and Stoll

[57] ABSTRACT

Paint applicator means for applying paint to a pad painter, comprising a conventional paint tray, a paint transfer roller, and mounting means for rotatably supporting the paint transfer roller on the conventional paint tray in partial immersion in the paint contained therein. Paint is applied to the pad painter by moving the pad painter across the paint transfer roller and causing the roller to rotate in the paint, thereby picking up paint from the paint tray and transfering it to the pad painter. The mounting means is adaptable to both deep and shallow well paint trays, and it includes support means for adjustably supporting the paint transfer roller a predetermined distance above the bottom wall of the paint tray, and at selected heights relative to the surface level of the paint.

5 Claims, 10 Drawing Figures

TRAY HAVING PAINT TRANSFER ROLLER FOR PAD PAINTERS

BACKGROUND OF THE INVENTION

1. Field of the Invention

Paint applicators for applying paint to pad painters used in house painting and other applications.

2. Description of the Prior Art

The closest prior patent art known to applicant consists of the following patents:

2,994,901 Ely
3,079,625 Rasmussen
3,100,313 Ernst
3,135,000 Rasmussen
3,648,322 Meisner The closest of these patents is Meisner, but this patent requires a special paint tray (called a paint "trough") and a cover therefor (called a "painting tool receiving tray having an elongated window therein overlying the trough and supported thereby"). Paint is applied to a pad painter by passing the pad painter across a roller which picks up paint from the trough and transfers through the window to the pad painter. There is no teaching in Meisner, or in any of the other prior art patents, of means for applying paint to a pad painter from a conventional paint tray (sometimes called a "paint roller tray").

SUMMARY OF THE INVENTION

The present invention provides convenient and effective means, including a conventional paint tray, for applying paint to pad painters. More specifically, the invention comprises an assembly consisting of a paint tray normally used to apply paint to paint rollers, a paint transfer roller, and mounting means for rotatably supporting said paint transfer roller on said paint tray.

The mounting means includes vertically elongated hook-shaped brackets or clips adapted to fit the high and low end walls of both deep and shallow well paint trays. The mounting means also includes looped supports for the bearing elements on which the paint transfer roller is rotatably mounted. These looped supports are engageable with the bottom wall of the paint tray to support the paint transfer roller in an elevated position sufficient for clearance above said bottom wall.

The paint transfer roller is provided with paint pickup and collecting means or configurations. In the preferred form of the invention, spaced longitudinal ribs are formed on the roller, defining longitudinally extending channels between them. The ribs function as pickup means for removing the paint from the tray; the channels function as transient paint retention means to carry the paint into contact with the pad painter.

The mounting means, in its preferred form, comprises a wire frame having a pair of hook-shaped bracket or clip elements in the back, and a pair of bearing elements in the front. The hook-shaped clip elements consist of horizontally connected, vertically elongated hook elements which may be slipped over or snapped onto the back wall of the paint tray. The elongated configuration of the hook elements makes it possible to raise or lower the wire frame relative to the bottom wall of the paint tray. The bearing elements support the paint transfer roller for rotation while partially submerged in the paint which is contained in the paint tray. Raising or lowering the wire mounting frame raises or lowers the paint transfer roller relative to the surface level of the paint.

Connecting the hook-shaped clip elements with the bearing elements are wire loops which are engageable with the bottom wall of the paint tray to help support the paint transfer roller in an elevated position, preventing it from rubbing against said bottom wall.

In the use of this device, a standard pad painter is moved across the paint transfer roller, thereby causing said roller to rotate in the paint and to carry the paint into contact with the pad painter. This means provides a simple and effective way to transfer paint from a conventional paint tray to the pad painter.

DESCRIPTION OF PREFERRED EMBODIMENTS OF THE INVENTION

Figure 1:
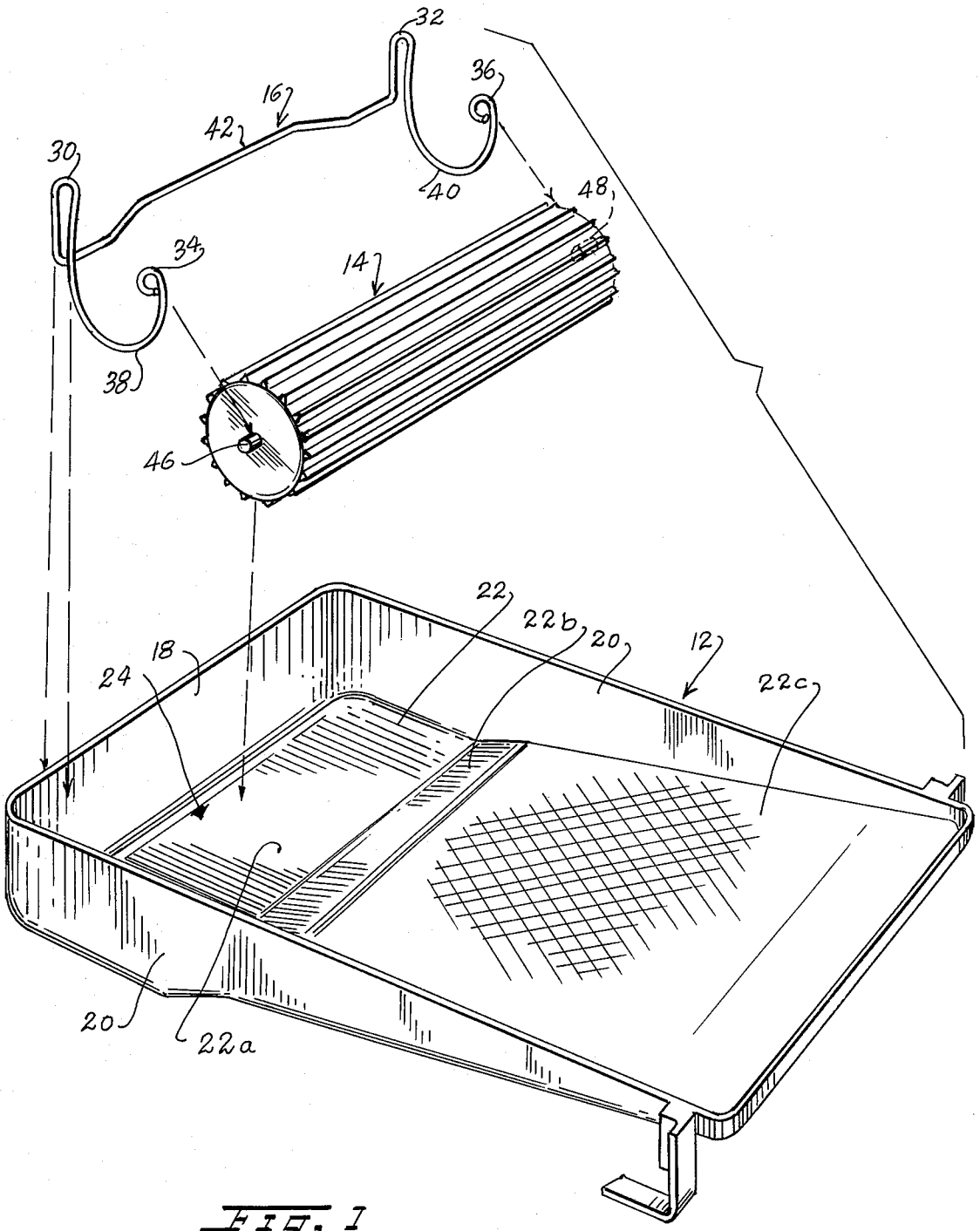
FIG. 1 is an exploded, perspective view of a paint applicator for pad painters made in accordance with the present invention, said view including a conventional paint tray used therewith.
Figure 2:
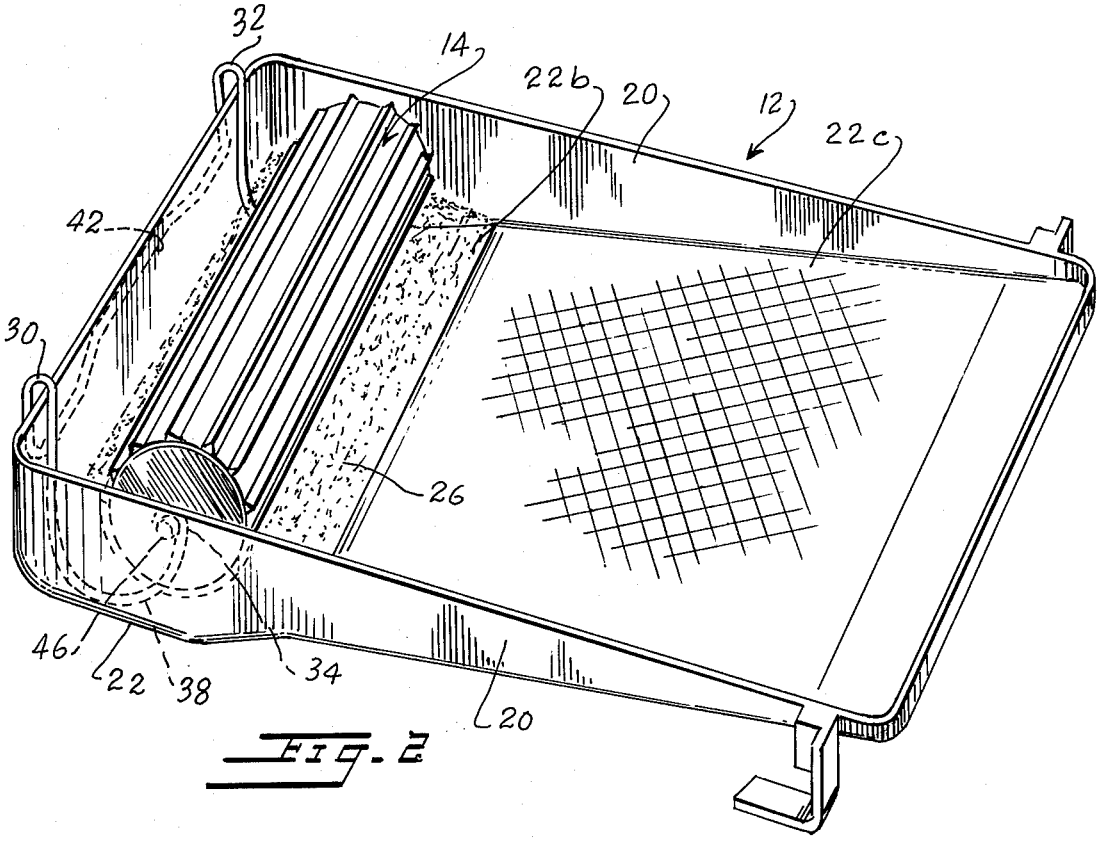
FIG. 2 is a perspective view showing the paint applicator assembled with the paint tray.
Figure 3:
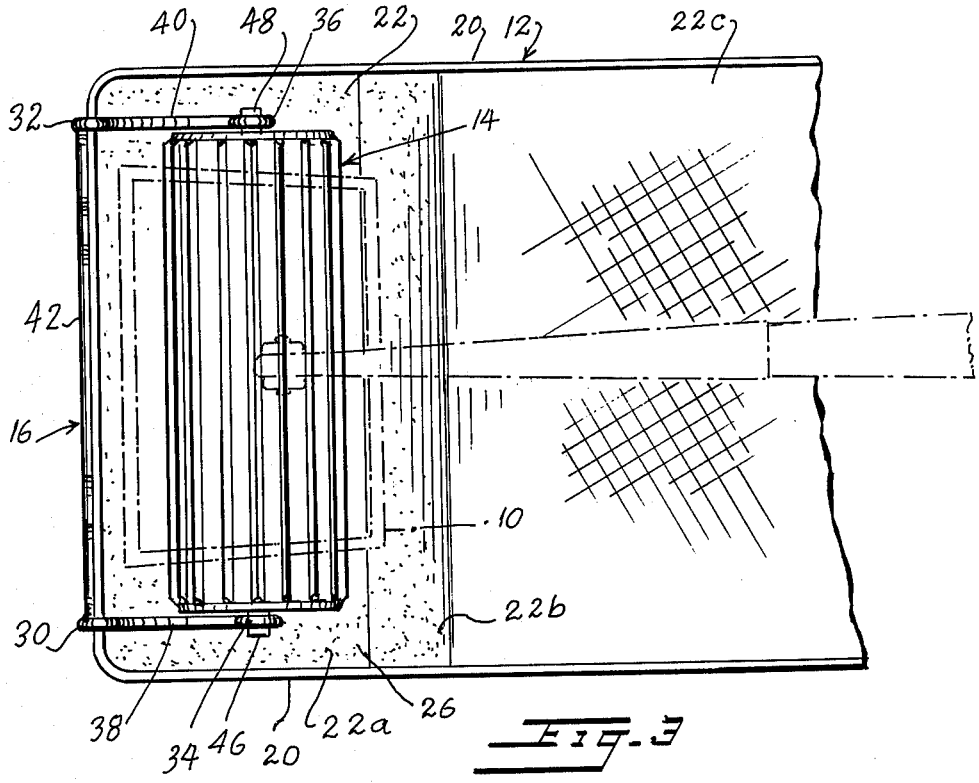
FIG. 3 is a fragmentary plan view of said assembly, showing a pad painter (in phantom view) in operative position relative to the paint transfer roller.
Figure 4:
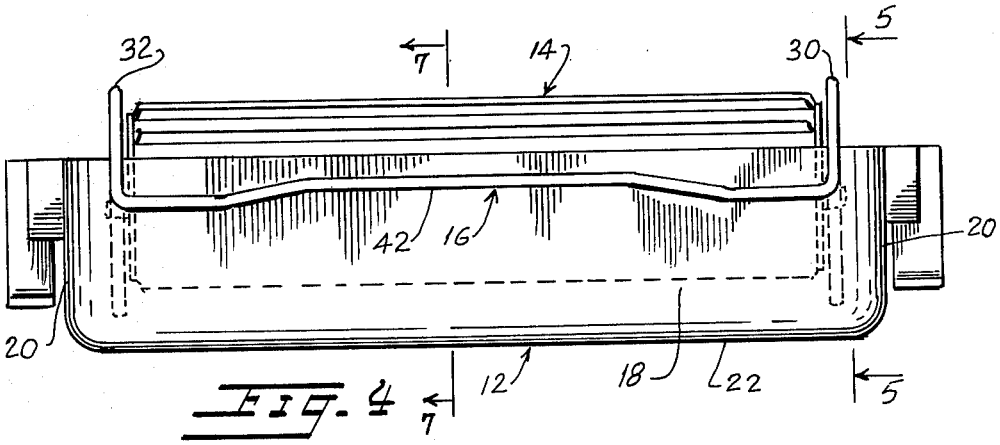
FIG. 4 is an end view of said assembly.
Figure 5:
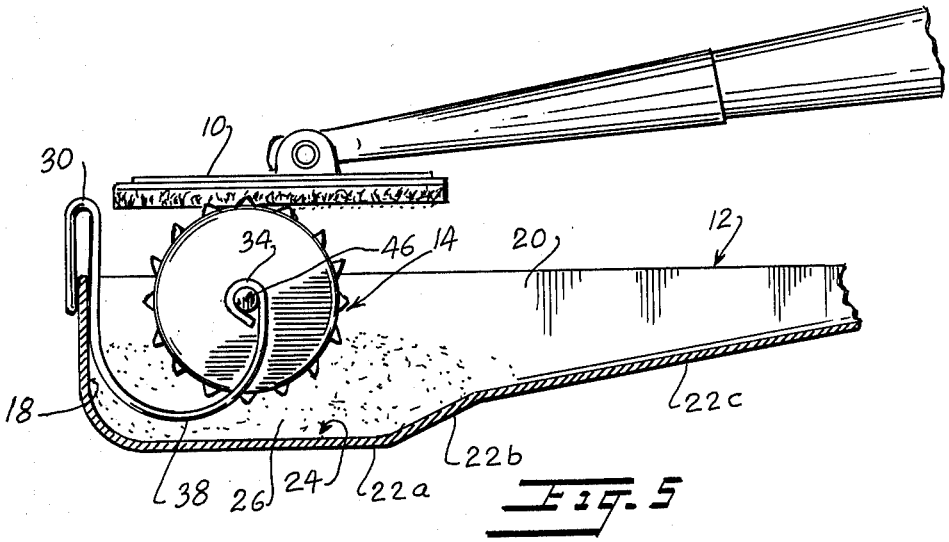
FIG. 5 is a fragmentary vertical section on the line 5—5 of FIG. 4, showing a pad painter in operative position across the paint transfer roller.
Figure 6:
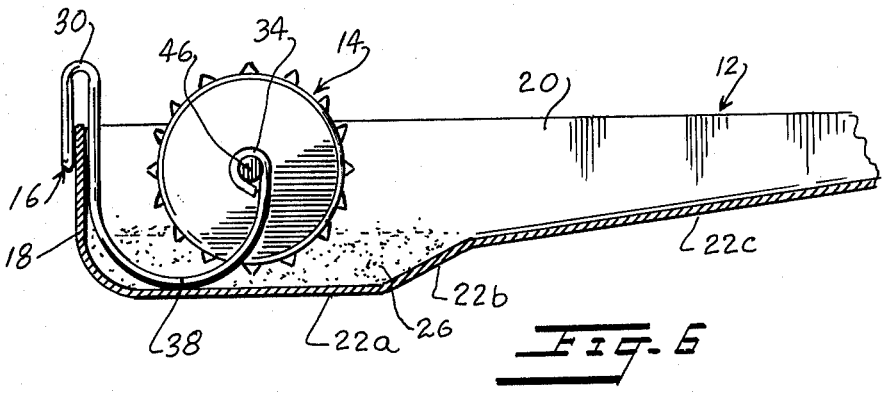
FIG. 6 is a fragmentary vertical section similar to that of FIG. 5 but showing the paint transfer roller mounted at a lower elevation relative to the bottom wall of the paint tray.
Figure 7:
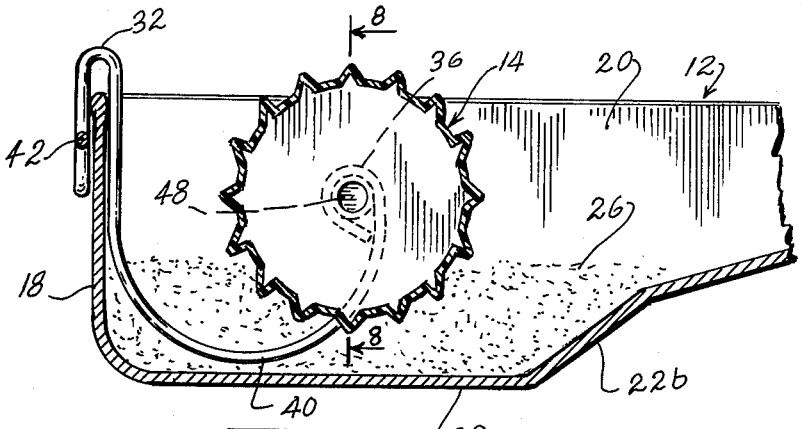
FIG. 7 is an enlarged, fragmentary vertical section on the line 7—7 of FIG. 4.
Figure 8:
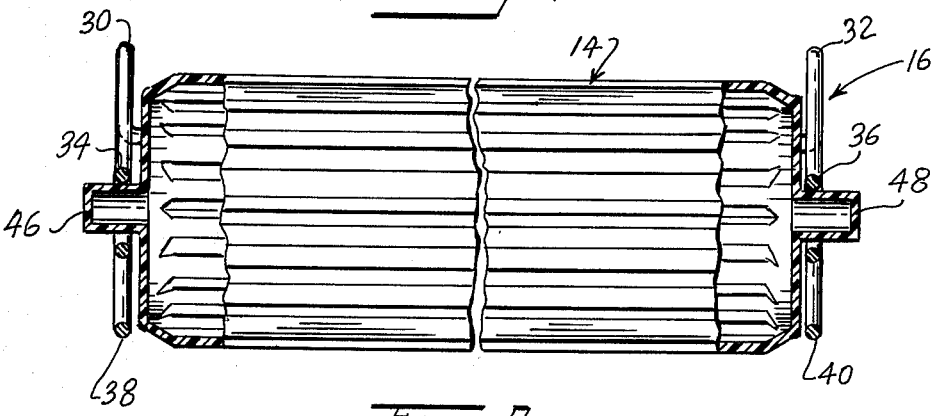
FIG. 8 is a fragmentary transverse section on the line 8—8 of FIG. 7.

With reference to the first form of the invention as illustrated in FIGS. 1–8 of the drawing, it will be seen that paint may be applied to pad painter 10 by means of the following paint applicator assembly: a conventional paint tray 12 (sometimes called a "paint roller tray" because it is generally used in conjunction with paint rollers), a paint transfer roller 14, and wire (or other) mounting means 16 to support said paint transfer roller on said paint tray.

The paint tray has an end wall 18, side walls 20, and a multi-level bottom wall 22, including a lower level *22a*, a sloping section *22c*, and a connecting section *22b*. A paint trough 24 is defined by walls 18 and 20 and bottom wall sections *22a*, *22b*. This is a conventional paint tray construction and it should be understood that the invention is equally applicable to other conventional paint tray constructions.

Mounting means 16 is adapted to be attached to end wall 18 of the paint tray. This mounting means comprises a pair of hook-shaped bracket or clip elements 30, 32, a pair of bearing elements 34, 36, and a pair of arcuate arms 38, 40 which interconnect bracket elements 30 and 32 with bearings 34 and 36 respectively. A cross member 42 interconnects hooks 30 and 32. Clips 30, 32, bearings 34, 36, arms 38 and 40 and cross-member 42 are all integral with each other, formed of a single wire.

It will be noted that hook-shaped bracket elements 30, 32 are vertically elongated. This enables them to be adjustably mounted on end wall 18 of the paint tray. There is sufficient tension in these hook-shaped clip elements to cause them to clip onto said end wall at selected positions thereon. The lowermost position of the transfer roller is determined by looped arms 38, 40 which function as limit elements when they engage the bottom wall of the paint tray, preventing said roller from rubbing against said wall. The vertical elongation of the hook-shaped bracket elements enables them to accommodate end walls of different heights while enabling the looped arms to rest against the bottom wall of the paint tray.

Bearing elements 34, 36 define a pair of eyes which are adapted to receive trunnions 46, 48. Spring tension in the wire frame that comprises mounting means 16 enables arms 38 and 40 to snap eyes 34, 36 into engagement with said trunnions. Transfer roller 14 is thereby rotatably supported by said mounting means for rotation in the paint.

It will be observed that longitudinally extending ribs are formed on the circumferential surface of said transfer roller. These ribs serve to pick up paint from the paint tray as the roller is rotated therein, and the channels which are formed between the ribs function as paint receptacles to carry the paint into contact with the pad painter 10. The paint is thereby transferred to the pad painter for conventional use.

Figure 9:
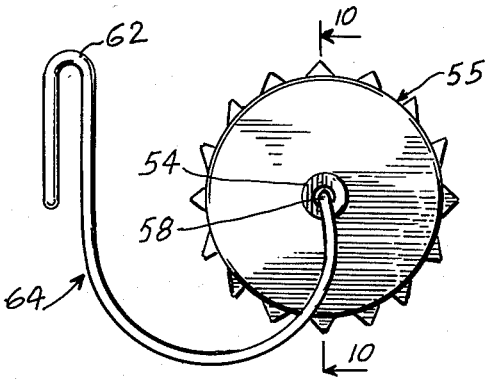
FIG. 9 is an end view of a modified form of paint transfer roller and mounting means therefor.
Figure 10:
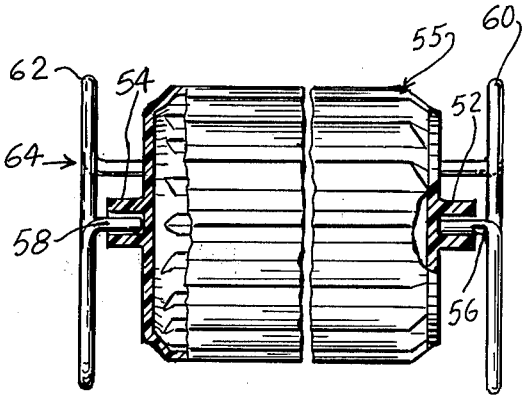
FIG. 10 is a fragmentary vertical section on the line 10—10 of FIG. 9.

A modified form of the invention is shown in FIGS. 9, 10 and it will there be seen that the only variation from the first form of the invention resides in the bearing means for supporting the transfer roller. In the modified form, coaxial socket bearings 52, 54 are provided on the ends of transfer roller 55 to receive stud shafts 56, 58 which are formed at the ends of arcuate arms 60, 62 of mounting means 64. These stud shaft ends substitute for eyes 34, 36 of the first form of the invention. In all other respects the two forms of the invention are identical and common parts have common reference numbers.

The foregoing is illustrative of preferred forms of the invention and it will be understood that variations and modifications thereof are intended to be encompassed within the scope of the appended claims. For example, the proportions of the parts shown in the drawing may be changed to adapt the invention to paint trays of different configuration and different proportions from those illustrated in the drawing. Also materials may vary, as desired. In the preferred forms of the invention the mounting means is made of metal wire, e.g., steel wire, but the mounting means may also be made of other materials such as plastics.

I claim:

1. A paint applicator for applying paint to a pad painter, said paint applicator comprising:

a. a paint tray having end, side and bottom walls defining a paint trough, b. a paint transfer roller, and c. mounting means for rotatably supporting the paint transfer roller on the paint tray for partial immersion in paint contained therein, d. whereby moving the pad painter across the paint transfer roller causes said roller to rotate in contact with the paint and to transfer the paint from the paint tray to the pad painter, e. said mounting means comprising a pair of interconnected hook-shaped clip elements which are adapted to be hooked onto the end wall of the paint tray, a pair of bearing elements which are adapted to support the transfer roller, and a pair of support arms extending from the clip elements and supporting the bearing elements, f. said paint transfer roller being journaled to said bearing elements, portions of the support arms extending below the roller, g. the hook-shaped clip elements being vertically elongated to adjustably support said paint transfer roller on end walls of different heights formed on paint trays having paint wells of different depths, h. the vertical dimensions of said hook-shaped clip elements being sufficient to enable the said portions of the support arms to engage the bottom wall of the paint tray, i. thereby preventing said paint transfer roller from rubbing against said bottom wall when rotated by the pad painter, j. said hook-shaped clip elements being vertically slidable on the end walls to raise or lower the paint transfer roller relative to the surface level of the paint in the paint well, k. thereby controlling the depth of immersion of the paint transfer roller in the paint.

2. A paint applicator in accordance with claim 1, wherein:

a. the paint transfer roller is provided with longitudinally extending circumferentially spaced ribs defining longitudinal channels between them, b. said ribs being adapted to pick up the paint from the paint tray as the roller is rotated therein by the pad painter, c. whereby the paint is collected within the channels and applied to the pad painter.

3. A paint applicator in accordance with claim 1, wherein:

a. the paint tray has an end wall, a pair of side walls, and a bottom wall connected to said end and side walls, b. a paint trough being formed between said end, side and bottom walls, c. said mounting means being positioned on the paint tray to support the paint transfer roller in said trough for immersion in paint contained therein.

4. A paint applicator in accordance with claim 3, wherein:

a. the bearing elements comprise a pair of coaxial eyes, b. the paint transfer roller being provided with a pair of coaxial end trunnions which are journaled into said coaxial eyes to rotatably support said paint transfer roller in the paint trough of the paint tray.

5. A paint applicator in accordance with claim 3, wherein:

a. the bearing elements comprise a pair of coaxial pin elements, b. the paint transfer roller being provided with a pair of coaxial socket bearings into which said coaxial pin elements are journaled to rotatably support said paint transfer roller in the paint trough of the paint tray.

* * * * *